United States Patent [19]

Mayled

[11] B 4,007,828

[45] Feb. 15, 1977

[54] CONTAINER AND CLOSURE

[76] Inventor: Edward Mayled, 133 Duke of Kent, Pointe Claire, Quebec, Canada

[22] Filed: Dec. 23, 1974

[21] Appl. No.: 536,923

[44] Published under the second Trial Voluntary Protest Program on March 30, 1976 as document No. B 536,923.

[52] U.S. Cl. ..... 206/1.5; 220/8; 229/9; 229/19

[51] Int. Cl.[2] ..... B65D 5/38; B65D 13/06

[58] Field of Search ..... 206/1.5; 229/9, 19; 220/8

[56] References Cited

UNITED STATES PATENTS

| | | | |
|---|---|---|---|
| 1,772,744 | 8/1930 | Barry | 220/8 |
| 1,822,576 | 9/1931 | Greue | 229/9 |
| 2,686,627 | 8/1954 | McElwee | 229/19 |
| 3,051,366 | 8/1962 | Sandstrom | 229/9 |
| 3,568,827 | 3/1971 | Haring | 206/1.5 |

*Primary Examiner*—William T. Dixson, Jr.
*Attorney, Agent, or Firm*—Alan Swabey & Co.

[57] ABSTRACT

A package having an improved means for releasably retaining the components of the package in assembly. Known similar package constructions require the use of additional material and necessitate the performance of additional manufacturing operations in order to provide closure flaps situated at opposite ends of a sleeve which is adapted to support a removable tray therein. The package according to the subject invention is of relatively simple construction, as well as being more economical than known similar packages. According to the subject invention, the improved package comprises a container and an enclosure having at least one open end. The container is adapted to be inserted into or removed from the enclosure through at least one open end thereof. The container and the enclosure are of substantially equal dimensions and have cooperating means on at least one pair of adjacent walls, the cooperating means adapted to provide a positive connection between the container and the enclosure whereby the container is releasably retained within the enclosure until the cooperating means are disengaged by a user.

4 Claims, 5 Drawing Figures

CONTAINER AND CLOSURE

BACKGROUND OF THE INVENTION

1. Field of the Invention

This invention relates generally to an improved package, and, in particular, to such a package having an improved means for releasably retaining the components of the package in assembly.

2. Description of the Prior Art

Known similar packages having a tray adapted to slidably fit in a cover have been developed, such covers consisting of a sleeve having closure flaps situated at opposite ends thereof, the flaps adapted to retain the tray within the sleeve. To remove the tray from the sleeve, it is necessary to open one of the closure flaps manually, thereby exposing the end of the tray to permit its removal from the sleeve. Because of their construction, such covers require the use of additional material and necessitate the performance of extra manufacturing operations in order to provide the closure flaps situated at the opposite ends of the sleeve. In addition, the necessity of opening and closing at least one of the closure flaps renders the use of such packages cumbersome.

SUMMARY OF THE INVENTION

The subject invention proposes to overcome the drawbacks associated with such known packages by providing an improved package which is of relatively simple construction, as well as being more economical than known similar packages. To achieve this, the subject invention provides an improved package with cooperating means to releasably retain the container within the enclosure or sleeve rather than providing the enclosure with closure flaps at its opposite ends.

According to the subject invention, the improved package comprises a container and an enclosure having at least one open end. The container is adapted to be inserted into or removed from the enclosure through at least one open end thereof. The container and the enclosure are of substantially equal dimensions and have cooperating means on at least one pair of adjacent walls, the cooperating means adapted to provide a positive connection between the container and the enclosure until the cooperating means are disengaged by a user.

According to a preferred embodiment of the subject invention, the cooperating means comprises projection means situated on at least one wall of the container and extending outwardly therefrom. The projection means are adapted to engage retaining means located in at least one respective wall of the enclosure.

According to a further embodiment of the subject invention, the at least one wall of the container incorporating the projection means is sufficiently flexible to permit disengagement of the projection means with the retaining means located in the at least one wall of the enclosure.

BRIEF DESCRIPTION OF THE DRAWINGS

In a drawing which illustrates embodiments of the invention according to the subject application.

DESCRIPTION OF THE PREFERRED EMBODIMENTS

Figure 2:
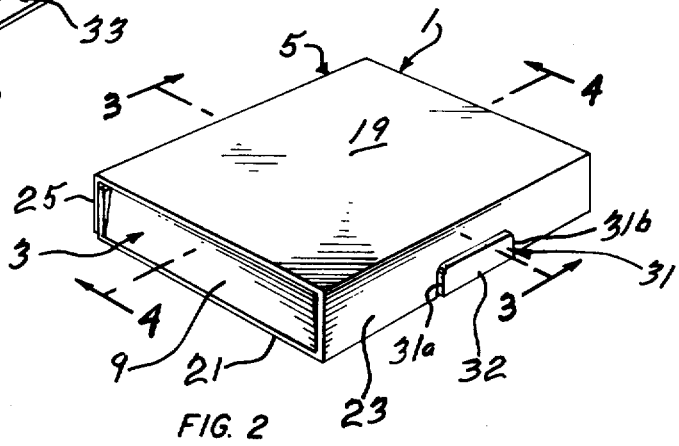
FIG. 2 is an enlarged perspective view of the container and enclosure when assembled.

The improved package, designated in FIG. 2 by reference numeral 1, comprises a container 3 and an enclosure 5 into which the container can be releasably inserted. The container 3 includes a plurality of compartments 7 for supporting breakable articles such as glass vials. To prevent breakage, each glass vial would be mounted in its own compartment 7.

The container 3 has spaced-apart outer and inner side walls. The outer side walls 9 are connected to the inner side walls 11 by a continuous peripheral top wall 13. The inner side walls are interconnected by bottom wall portions 15. The compartments 7 are defined by partitions 17 which are parallel to the end walls of the container and extend the width thereof. The container is made from a flexible thermoplastic material, thereby permitting the containers to be vacuum or pressure formed in one piece.

The interior dimensions of the enclosure 5 are such as to permit the enclosure to slidably receive container 3 in such a manner as to offer protection to the container and its contents. The enclosure 5 includes a top wall 19 and a bottom wall 21 which are interconnected along their longitudinal edges by opposed side walls 23 and 25. The opposite ends 27 defined by the enclosure 5 are open. The enclosure 5 is made from a single blank of cardboard material which is scored across its width to define the side walls, top wall and bottom wall of the enclosure. Opposite ends of the scored single blank define the side wall 25 and a manufacturer's flap 29, the outer surface of flap 29 being glued to the inner surface of the side wall 25 when forming the enclosure 5. The forming of the enclosure 5 is carried out in a known manner.

Figure 5:
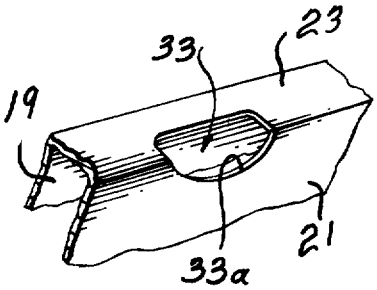
FIG. 5 is an enlarged fragmentary perspective view of a further embodiment of a component of the cooperating means of an enclosure and container when assembled.
Figure 3:
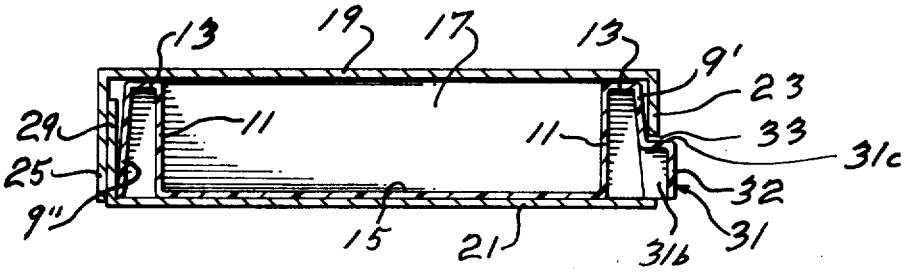
FIG. 3 is an enlarged vertical section of the embodiment according to FIG. 2, taken along the line 3—3.
Figure 4:
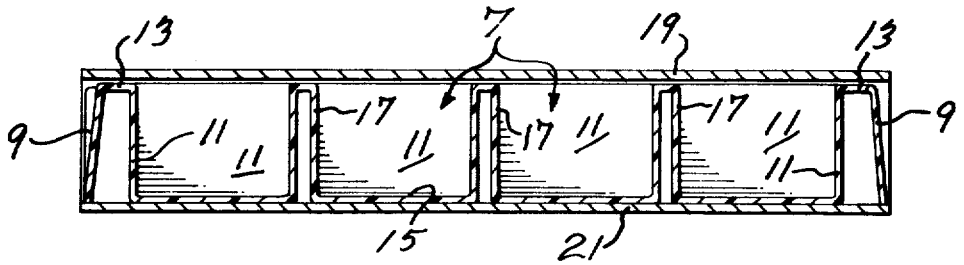
FIG. 4 is a vertical section of the embodiment according to FIG. 2, taken along the line 4—4.

Cooperating means are provided on the container and enclosure in order to releasably retain the container within the enclosure. The cooperating means comprises a projection means 31 which projects outwardly from an outer side wall 9′ of the container 3, and the retaining means in the embodiment according to FIGS. 1 and 2 comprises an opening 33 situated in the side wall 23 of the enclosure 5. In the embodiment of FIG. 5, the opening 33 also includes a notch portion 33*a* in bottom wall 21 adjacent side wall 23. The notch portion 33*a* facilitates the urging of the projection means 31 inwardly during removal of the container from the enclosure. The projection means 31 comprises a tab which is integral with the side wall 9′ and is slightly smaller but identical in configuration in plan view to the opening 33. When inserted in the enclosure 5, the side wall 9′ of the container 3 lies adjacent the side wall 23 of the enclosure and an outer portion of the projection means 31 extends outwardly of the outer surface of the side wall 23. The projection means 31 is defined by vertical sides 31*a* and 31*b*, a top surface 31*c*, and an outer surface 32. Engagement between the vertical sides 31*a* and 31*b* of the projection means and the adjacent vertical edges of the opening 33 provides a positive connection between the container and the enclosure, releasably retaining the container 3 within the enclosure 5.

The projection means is situated adjacent the lower edge of the side wall 9′ to permit the maximum amount of deflection of the side wall 9′ as the projection means 31 is pressed inwardly, out of engagement with the opening 33. The application of pressure against projection means 31 is facilitated by using a notch portion 33*a*, as shown in FIG. 5. In addition, as shown in the drawing, the projection means 31 is located approximately half way along the length of the side wall 9′ in order to permit maximum inward deflection of the wall 9′ as the projection means 31 is urged inwardly. The position of the projection means 31 in the wall 9′ corresponds to the position of the opening 33 in the side wall 23 of the enclosure 5.

Figure 1:
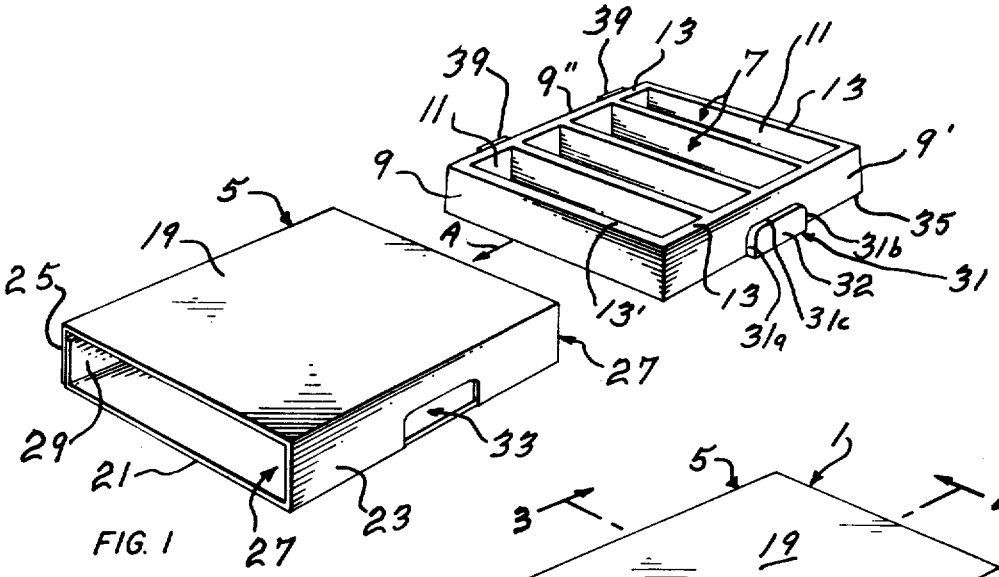
FIG. 1 is a perspective view of the enclosure and container prior to assembly.

When the container 3 is slid into the enclosure 5, in the direction of the Arrow "A" shown in FIG. 1, the projection means 31 on the outer side wall 9′ is urged inwardly by the user in such a direction perpendicular to the side wall 9′. Since the lower edge 35 of the side wall 9′ is unsupported, the projection means 31 moves inwardly relatively easily as the container 3 is inserted into the enclosure 5. As a result, slight pressure applied to the projection means 31 by the user permits the vertical edge 31*a* to be bent inwardly of the end of the side wall 23, thereby facilitating the insertion of the container into the enclosure. When the container reaches the position shown in FIG. 2 of the drawing, the projection means 31 is aligned with the opening 33, and the side wall 9′, due to its inherent flexibility, urges the projection means 31 outwardly through the opening 33. In this position, the side wall 9′ is in its normal position. With the projection means 31 extending outwardly through the opening 33, the container 3 is releasably secured within the enclosure 5.

To remove the container 3 from the enclosure 5, the projection means 31 is urged inwardly by the user, such that the outer surface 32 is situated inwardly of the inner surface of the side wall 23. As the projection means is urged inwardly, the container is pushed at either end toward one or other of the open ends 27 of the enclosure 5.

An outer side wall 9″, opposite from the outer side wall 9′, is provided with wedges 39 which extend outwardly from the outer surface. Wedges 39 extend the height of the side wall 9″ and their width is tapered inwardly from top to bottom. The outer surfaces of the wedges 39 cooperate with the adjacent side wall 25 in order to align the container 3 within the enclosure 5. The wedges 39 are integral with the container 3 and also serve to reinforce the outer side wall 9″ of the container which urges the container 3 towards the wall 23 of the enclosure 5, thereby assisting the retaining of the container 3 in the enclosure 5.

I claim:

1. An improved package comprising a container and an enclosure having at least one open end; the container adapted to be inserted into the enclosure through the at least one open end thereof; the container and the enclosure being of substantially equal dimensions and having cooperating means on at least one pair of adjacent walls, the cooperating means comprises projection means situated on at least one wall of the container and retaining means located in at least one adjacent wall of the enclosure, the projection means including a continuous surface portion extending outwardly therefrom, the retaining means comprising an opening situated in at least one side wall of the enclosure, the continuous surface portion of the projection means adapted to releasably engage edges of one of the at least one opening forming the retaining means, whereby engagement between the continuous surface portion and the edges of one of the at least one opening provide a positive connection between the projection means and the retaining means whereby depression of the projection means out of engagement with the retaining means must be effected in order to disengage the cooperating means.

2. An improved package according to claim 1, wherein the continuous surface portion comprises two substantially vertical side surfaces and a horizontal top surface, the at least one opening forming the retaining means having substantially vertical edges and a horizontal top edge so adapted as to permit passage of the projection means therethrough, the substantially vertical side surfaces of the continuous surface portion adapted to engage the substantially vertical edges of the opening in order to provide a positive connection between the container and the enclosure, thereby preventing sliding movement of the container relative to the enclosure during engagement of the projection means and retaining means.

3. An improved package according to claim 2, wherein the substantially vertical edges of the at least one opening extend from the top edge thereof to a longitudinal edge of the at least one adjacent side wall of the enclosure, each longitudinal edge defining a line of separation between the at least one side wall of the enclosure and a bottom wall thereof, the at least one opening including a notch portion in the bottom wall of the enclosure, each notch portion adapted to facilitate disengagement of the projection means from the opening by permitting a user to apply pressure to a lower edge of the projection means, thereby urging the projection means out of contact with the at least one opening so as to release the positive connection between the enclosure and container.

4. An improved package according to claim 1, wherein the projection means is situated on one side wall of the container and identical openings are situated in each of the two side walls of the enclosure, the projection means adapted to engage one or other of the two openings, the enclosure also including two open ends whereby the container can be inserted into the enclosure through either open end thereof.

* * * * *